US011002494B2

(12) United States Patent
Ruckwied et al.

(10) Patent No.: US 11,002,494 B2
(45) Date of Patent: May 11, 2021

(54) HEAT EXCHANGER

(71) Applicant: Mahle International GmbH, Stuttgart (DE)

(72) Inventors: Jens Ruckwied, Stuttgart (DE); Eberhard Pantow, Winnenden (DE); Volker Kurz, Stuttgart (DE); Jochen Haeussermann, Oberstenfeld (DE); Walter Demuth, Weil im Schoenbuch (DE); Harald Bronner, Bad Liebenzell (DE)

(73) Assignee: Mahle International GmbH

( * ) Notice: Subject to any disclaimer, the term of this patent is extended or adjusted under 35 U.S.C. 154(b) by 38 days.

(21) Appl. No.: 15/158,330

(22) Filed: May 18, 2016

(65) Prior Publication Data

US 2016/0341494 A1 Nov. 24, 2016

(30) Foreign Application Priority Data

May 19, 2015 (DE) ..... 102015209130.9

(51) Int. Cl.
*F28F 9/013* (2006.01)
*F28D 1/053* (2006.01)
(Continued)

(52) U.S. Cl.
CPC ..... *F28F 9/0131* (2013.01); *F28D 1/05383* (2013.01); *F28F 9/0224* (2013.01);
(Continued)

(58) Field of Classification Search
CPC .... F28F 9/18; F28F 9/182; F28F 9/185; F28F 2225/08; F28F 9/0224; F28D 1/05383
(Continued)

(56) References Cited

U.S. PATENT DOCUMENTS 5,036,913 A * 8/1991 Murphy ..... B23K 1/0012 165/153
5,238,059 A * 8/1993 Smith ..... F28F 9/0224 165/153
(Continued)

FOREIGN PATENT DOCUMENTS

DE 102005058177 A1 6/2006
DE 102006057851 A1 * 6/2008 ..... F28D 1/0391
(Continued)

OTHER PUBLICATIONS

English abstract for DE-102008033594.
(Continued)

*Primary Examiner* — Joel M Attey
*Assistant Examiner* — For K Ling
(74) *Attorney, Agent, or Firm* — Fishman Stewart PLLC

(57) ABSTRACT

A heat exchanger may include a heat exchanger block including a plurality of flat tubes held at a longitudinal end side in a respective rim hole of an associated tube plate. The respective rim hole may have at least two mutually opposite and substantially straight long sides and at least two mutually opposite narrow sides. A brazed connection may be disposed between at least one of the at least two long sides of at least one of the respective rim holes and a corresponding one of the flat tubes arranged therein, and the brazed connection may have an undulating brazing boundary. At least one of the plurality of flat tubes may include at least one partition. The undulating brazing boundary may have a high point that defines an increased thickness in relation to a plane running through two opposite groove bases disposed in the tube plate.

19 Claims, 3 Drawing Sheets

(51) Int. Cl.
*F28F 9/02* (2006.01)
*F28F 9/18* (2006.01)
*F28D 21/00* (2006.01)

(52) U.S. Cl.
CPC ..... *F28F 9/18* (2013.01); *F28F 9/182* (2013.01); *F28D 2021/0094* (2013.01); *F28F 2225/04* (2013.01); *F28F 2275/04* (2013.01)

(58) Field of Classification Search
USPC ..... 165/172, 173
See application file for complete search history.

(56) References Cited

U.S. PATENT DOCUMENTS 6,446,713 B1 * 9/2002 Insalaco ..... F28D 1/05366 165/173
6,640,887 B2 * 11/2003 Abell ..... F28F 9/0214 165/173
6,786,275 B2 * 9/2004 Dey ..... F28D 1/0535 165/149
6,830,100 B2 * 12/2004 Gowan ..... F28F 9/0212 165/153
7,237,605 B2 * 7/2007 Ozaki ..... F28D 1/05366 165/149
8,181,694 B2 * 5/2012 Powers ..... F28F 9/0226 165/149
2004/0031598 A1 * 2/2004 Shimanuki ..... F28F 1/022 165/164
2004/0050540 A1 * 3/2004 Kato ..... F28D 1/0391 165/153
2006/0254761 A1 * 11/2006 Watanabe ..... B23K 1/0012 165/173
2007/0175620 A1 * 8/2007 Watanabe ..... B23K 1/0012 165/173
2013/0160973 A1 * 6/2013 Riondet ..... F28F 9/0226 165/104.19
2014/0054018 A1 2/2014 Augenstein et al.
2015/0168080 A1 * 6/2015 Honma ..... F28F 9/0224 165/157

FOREIGN PATENT DOCUMENTS

DE 102006057851 A1 6/2008
DE 102007059673 A1 8/2008
DE 102008033594 A1 * 2/2009 ..... F28F 9/02
DE 102008033594 A1 2/2009
DE 102011075071 A1 11/2012
DE 102013208424 A1 11/2014
DE 102013225189 A1 6/2015
FR 2877077 A1 * 4/2006 ..... F25B 39/04
GB 169855 A * 10/1921 ..... F28D 1/0535
JP 07019784 A * 1/1995 ..... F28F 9/182
WO WO 2008071362 A1 * 6/2008 ..... F28F 9/0224

OTHER PUBLICATIONS

English abstract for DE-102006057851.
English abstract for DE-102007059673.
German Search Report for DE-102015209130.9, dated Jan. 20, 2016.
Extended European Search Report dated Nov. 22, 2016 in relation to European Application No. 16168940.1.

* cited by examiner

HEAT EXCHANGER

CROSS-REFERENCE TO RELATED APPLICATIONS

This application claims priority to German Patent Application No. 10 2015 209 130.9, filed May 19, 2015, the contents of which are hereby incorporated by reference in its entirety.

TECHNICAL FIELD

The present invention relates to a heat exchanger having a heat exchanger block with flat tubes which are each held at a longitudinal end side in a rim hole of an associated tube plate. The invention also relates to a motor vehicle equipped with a heat exchanger of said type.

BACKGROUND

DE 10 2013 208 424 A1 has disclosed a generic heat exchanger, in particular for a motor vehicle, having a heat exchanger block with flat tubes which are each held at a longitudinal end side in a rim hole of an associated an tube plate. Here, each rim hole has two mutually opposite and substantially straight long sides and two mutually opposite narrow sides, wherein each flat tube is brazed to the long sides and to the narrow sides of the rim hole. Here, a border of a rim hole corner region is formed between the long side and the narrow side. The border of the rim hole corner region has a straight profile relative to a base plane spanned by the long side, or is, above the base plane spanned by the long side, of arched form so as to run toward the base plane. In this way, it is intended to be able to produce a tube-plate connection which can better accommodate forces arising as a result of temperature changes and mechanical loading.

DE 10 2007 059 673 A1 has disclosed a heat exchanger for the exchange of heat between a first fluid and a second fluid, which heat exchanger has a block for conducting the first and second fluids separately from one another and in heat-exchanging fashion. The heat exchanger block in this case comprises flat tubes which are held by way of their longitudinal end sides in rim holes of tube plates. Here, the rim holes have at least one delimiting contour which is arched away from a plane substantially perpendicular to the tube axial direction and which runs with a spacing to said plane, wherein a spacing value at least at a transition between the tube narrow side and the tube wide side is smaller than a spacing value at the tube wide side, in such a way that stresses in the region of the transition can be reduced. In this way, it is sought in particular to be able to increase the durability of the heat exchanger.

In general, owing to the reduction in the tube wall thicknesses, the fluctuating temperature loading in the case of motor vehicle coolant coolers is of ever-increasing significance.

The present invention is therefore concerned with the problem of specifying, for a heat exchanger of the generic type, an improved or at least alternative embodiment which, in particular also in the case of thin-walled flat tubes with at least one partition, is distinguished by increased durability in the partition region.

Said problem is solved according to the invention by way of the subject matter of the independent claim(s). The dependent claims relate to advantageous embodiments.

SUMMARY

The present invention is based on the general concept whereby, in the region of a brazing surface between a flat tube and a rim hole in a tube plate, at least one long side, preferably both long sides, of the rim hole is/are designed, for example by way of corresponding lugs or the formation of depressions, such that a brazing surface that will later form between the at least one long side of the rim hole and the flat tube has a brazing boundary or a braze edge with an undulating profile, wherein a high point of the undulating profile of the brazing boundary coincides with a partition, in particular with a fold, of the respective flat tube, whereby considerably increased resistance to temperature fluctuations can be achieved, which has been confirmed for example by way of FEM calculations. For this purpose, the heat exchanger according to the invention has, in a known manner, a heat exchanger block with flat tubes which are each held at a longitudinal end side in a rim hole of the associated tube plate. Here, each rim hole has two mutually opposite and substantially straight long sides and two mutually opposite narrow sides. Furthermore, each flat tube is brazed to the long sides and to the narrow sides of the rim hole. According to the invention, it is now the case that at least one brazed connection between at least one of the long sides of at least one rim hole and a flat tube arranged therein has an undulating brazing boundary, which may be formed for example by way of undulating depressions which, in the case of flat tubes brazed in the rim holes, generate a likewise undulating profile of the brazing boundary in said region, that is to say along the associated long side. The undulating brazing boundary, which self-evidently has high points and low points, is now aligned relative to the at least one partition of the flat tube such that the brazing boundary has, in the region of the at least one partition, in particular of the at least one fold, a high point and thus, in particular, a reduced width in relation to the free edge of the rim hole. In this way, it is possible for a considerable reduction of stresses in the partition region to be achieved, which corresponds to a considerable lengthening of service life under temperature loading. Altogether, by way of the embodiment according to the invention of at least one of the long sides of a rim hole with the undulating brazing boundary resulting from this, and by way of the alignment of the high points of the undulating brazing boundary with the partition of the flat tube, considerably increased temperature resistance of the heat exchanger can be achieved.

In an advantageous refinement of the solution according to the invention, the undulating brazing boundary runs spaced apart from a free edge of the rim hole. Altogether, a brazed surface is thus obtained which, in the upward direction, terminates in rectangular fashion with respect to the free edge of the rim hole and, in the downward direction, terminates by way of the undulating profile of the brazing boundary or the braze edge, whereby it is possible for a brazed connection to be realized which not only covers a large area and is thus reliable, but which is also highly resistant to temperature loading owing to the special undulating profile according to the invention of the brazing boundary with the arrangement of a high point in the region of the at least one partition, in particular of the at least one fold, of the flat tube. Here, it is preferably provided that the undulating brazing boundary has a number of high points corresponding to the number of partitions.

In an advantageous refinement of the solution according to the invention, the brazing boundary has, in the region of the high point and/or of the low point, two flanks which are each angled relative to a horizontal by an angle $\alpha$ of $7° \leq \alpha \leq 30°$. Depending on the selected angle, it is possible here, in combination with the wavelength, to realize a shallower or steeper profile of the brazing boundary.

In an advantageous refinement of the solution according to the invention, the brazing boundary has a height difference h of 1.5 mm≤h≤2.5 mm between the high point and the low point. Through the determination and/or specification of the amplitude of the undulating profile of the brazing boundary, which corresponds to half of the height, it is likewise possible for the durability to be influenced.

In a further advantageous embodiment of the solution according to the invention, the undulating brazing boundary has a wavelength l of 4.0 mm≤l≤26.0 mm. Said range already makes it evident that, in particular for heat exchangers of different size, the wavelength l of the undulating brazing boundary can be easily adapted to the respective size of the flat tube or of the rim hole.

In a further advantageous embodiment of the solution according to the invention, the undulating brazing boundary transitions via a high point into the narrow side of the rim hole. The narrow side may in this case be arranged at right angles to the two long sides, or else may be of semicircular form, wherein accommodation of greater stresses is possible by way of the transitioning of the undulating brazing boundary via a high point into the narrow side. Since said corner regions in particular are subject to high stresses in the event of temperature loading, it is possible in this way, too, for the service life of the heat exchanger according to the invention to be lengthened.

Further important features and advantages of the invention will emerge from the subclaims, from the drawings and from the associated description of the figures on the basis of the drawings.

It is self-evident that the features mentioned above and the features yet to be discussed below may be used not only in the respectively specified combination but also in other combinations or individually without departing from the scope of the present invention.

Preferred exemplary embodiments of the invention are illustrated in the drawings and will be discussed in more detail in the following description, wherein the same reference signs are used to denote identical or similar or functionally identical components.

BRIEF DESCRIPTION OF THE DRAWINGS

In the drawings, in each case schematically.

DETAILED DESCRIPTION

Figure 1:
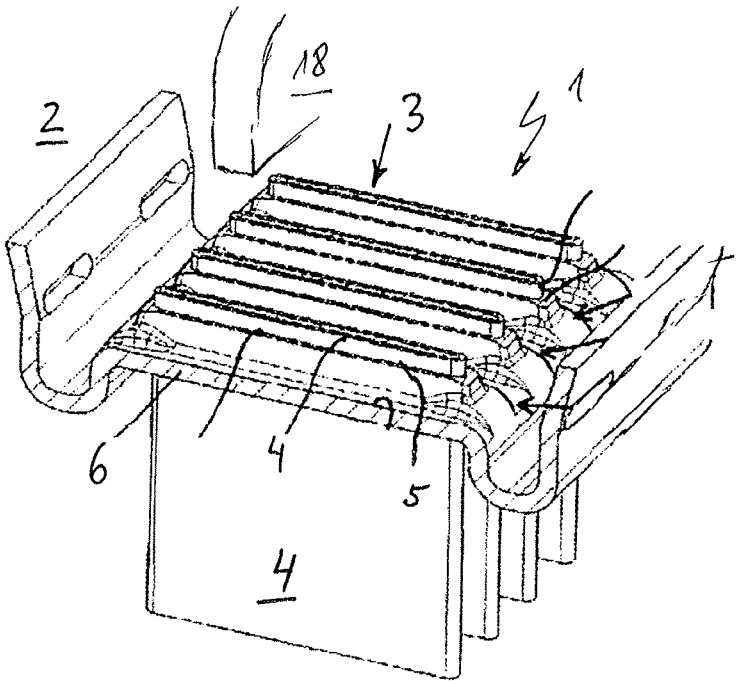
FIG. 1 shows a partially sectional view through a heat exchanger according to the invention.

Corresponding to FIG. 1, a heat exchanger 1 according to the invention, which can be used for example as a coolant cooler in a motor vehicle 2, has a heat exchanger block 3 with flat tubes 4, which are each held at a longitudinal end side in a rim hole 5 (cf. also FIGS. 2 to 4) of an associated tube plate 6. Here, each rim hole 5 has two mutually opposite and substantially straight long sides 7 and two likewise mutually opposite narrow sides 8, wherein the latter may for example be of semicircular form. Each of the flat tubes 4 is in this case brazed, over a part of its outer surface, to the long sides 7 and to the narrow sides 8 of an associated rim hole 5. According to one aspect of the invention, at least one of the long sides 7 of at least one rim hole 5 has undulating depressions 11, for example in the form of indentations, which, in the case of a flat tube 4 having been brazed in the associated rim hole 5, yield a brazing surface with an undulating brazing boundary 12 or an undulating braze edge 12 (cf. FIGS. 1 to 4). Alternatively, the undulating brazing boundary 12 may also be formed by correspondingly shaped lugs 21 (cf. FIG. 5). For the production of the brazed connection or of a joined brazing surface or of a joined brazing layer, braze may be applied either to the rim hole 5 or to ends of the flat tubes 4 or to both, for example by way of a braze plating. The at least one flat tube 4 has at least one partition 10, wherein the brazing boundary 12 has, in the region of the at least one partition 10, a high point 13 and thus a reduced width b relative to a free edge 15 of the rim hole 5. If the free edge 15 does not have a line/straight line, it is also possible for a line/plane 20 which runs through two opposite groove bases 19, 19' of the tube plate 6 to be taken as a reference, such that in this case, the brazing boundary 12 has, in the region of the at least one partition 10, a high point 13 and thus an increased width c in relation to a line/plane 20 running through two opposite groove bases 19, 19' of the tube plate 6. It is self-evidently also conceivable for both long sides 7 of the at least one rim hole 5 to have the undulating brazing boundaries 12 and/or the undulating depressions 11.

Figure 2:
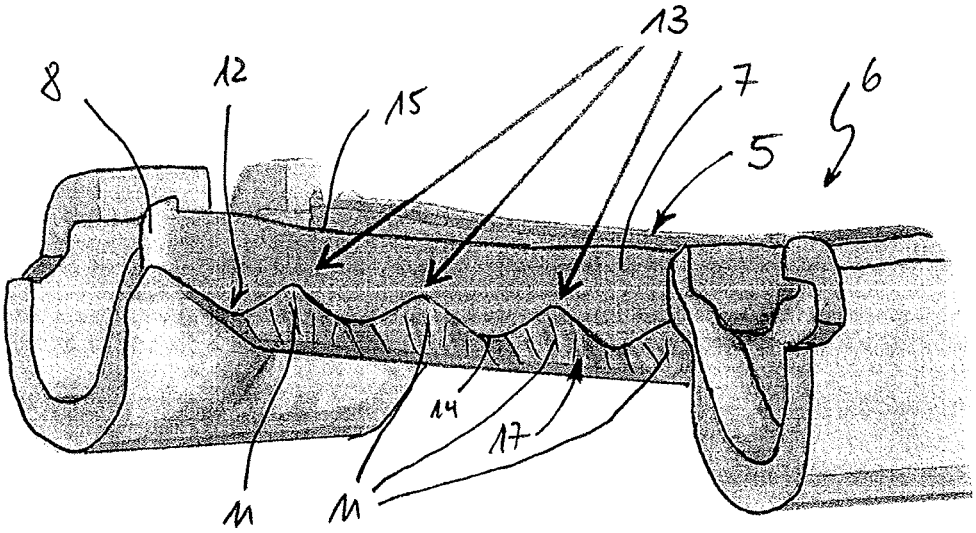
FIG. 2 is a sectional illustration through a tube plate of the heat exchanger according to the invention in the region of a rim hole.
Figure 3:
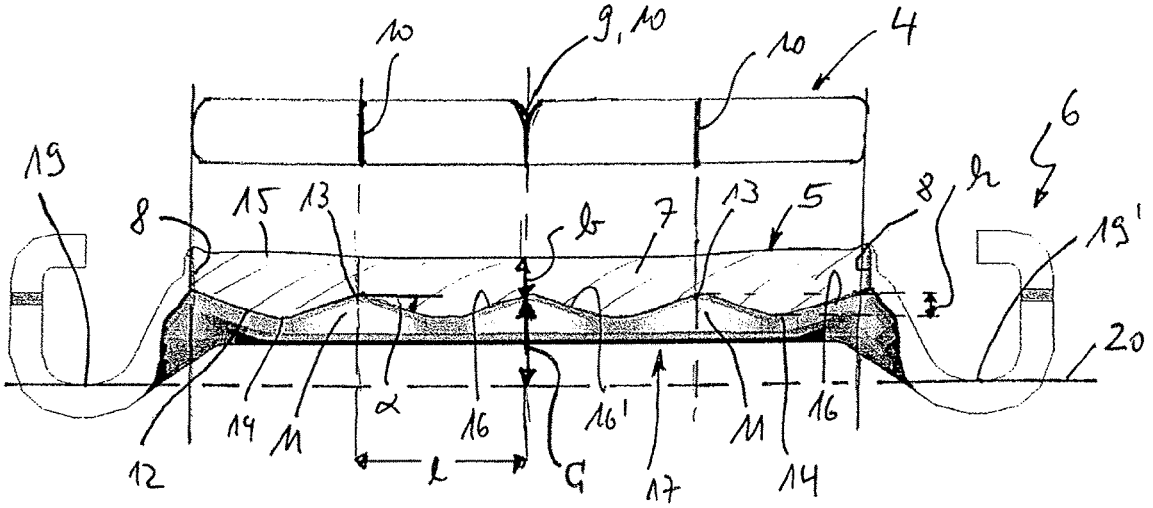
FIG. 3 is an illustration as in FIG. 2, with braze flanks, which run in flat fashion, for a flat tube with a fold and two webs.
Figure 4:
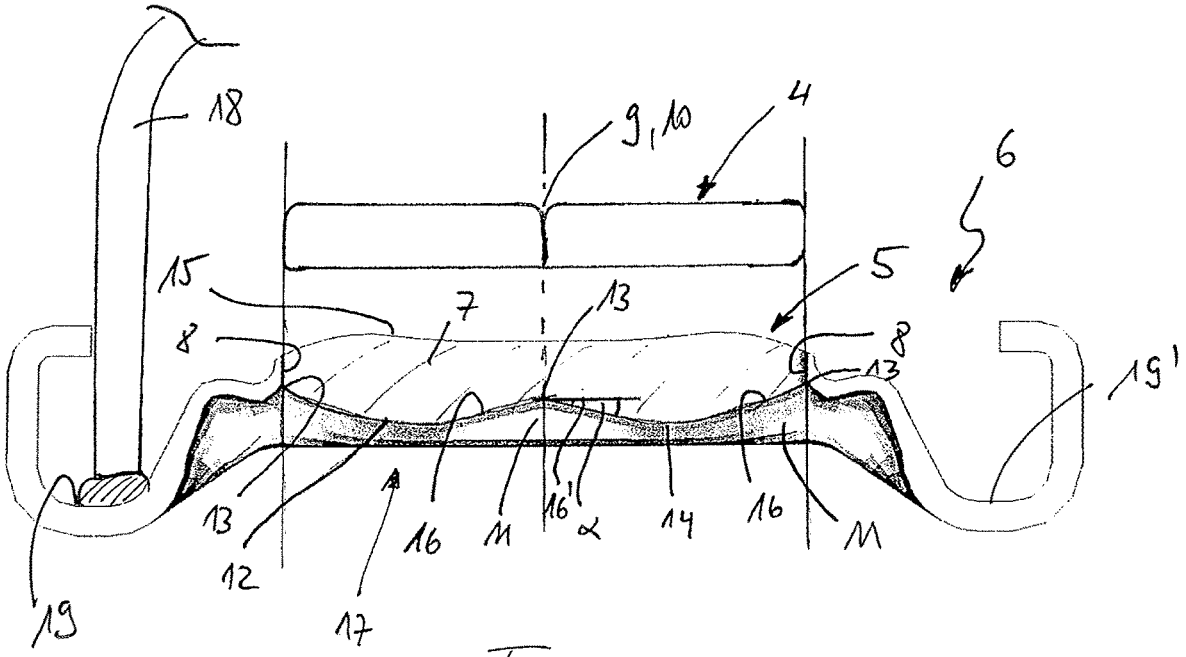
FIG. 4 is an illustration as in FIG. 3, but for a flat tube with a fold.

The brazing boundary 12 is in this case not illustrated directly in FIGS. 2 to 4, but the position thereof is shown. The partition 10 may in this case be in the form of a fold 9, in particular if the flat tube 4 is in the form of a folded flat tube 4. Alternatively, the flat tube 4 may be in the form of a welded webbed tube or extrusion-moulded tube, that is to say extruded flat tube 4. A partition 10 may thus also be a web or may be produced by extrusion together with the flat tube 4 during the extrusion process. The undulating edge of the depressions 11 may have a regularly repeating profile with regard to amplitude and/or wavelength. Furthermore, the undulating edge of the depressions 11 may have a mathematically discontinuous profile.

The undulating brazing boundary 12 and the undulating depressions 11 are, in the exemplary embodiment, arranged at an insertion side 17 of the long side 7 of the rim hole 5 of the tube plate 6. The respective insertion sides 17 of the rim hole 5 are averted from a header tank 18 of the heat exchanger 1 (cf. FIG. 1) and thus face toward a long-side tube centre of the flat tube 4 arranged in the rim hole 5.

The undulating profile of the brazing boundary 12 and in particular the congruent arrangement of the high points 13 of the brazing boundary 12 with the partitions 10 or the fold 9 lead to a considerable reduction of the stresses in said region under temperature loading, whereby considerably increased resistance of the heat exchanger 1 to temperature fluctuations can be achieved. Here, FEM calculations have, with the described geometry, shown that a profile of the brazing boundary 12 designed according to the invention and aligned with respect to the fold 9 or the partition 10 yields a considerable stress reduction and thus a considerable lengthening of the service life under temperature loading. A further major advantage of the undulating brazing boundary 12 formed for example by the depressions 11 or indentations lies in the easy insertion of the flat tubes 4 into the rim holes 5, without the risk of misalignment occurring in the process. Here, the undulating depressions 11 may at the same time form an insertion bevel, in particular also in the region of the low points 14, which facilitates the insertion of the flat tube 4 into the associated rim hole 5.

Considering FIGS. 2 to 6, it can be seen that the undulating brazing boundary 12 runs spaced apart from the free edge 15 of the rim hole 5. Said brazing boundary thus delimits, together with the free edge 15, a brazing surface, the width b of which is reduced in particular in the region of the fold 9 or of the partitions 10. In said region, the high point 13 also has an increased width c in relation to a line/plane 20 running through two opposite groove bases 19, 19' of the tube plate 6 (cf. FIGS. 3 to 6). Here, it is self-evidently clear that the free edge 15 may be of rectilinear form, or else likewise has a lightly curved profile, as illustrated for example in FIG. 4. Here, in FIG. 4, the free edge 15 is lowered slightly in the region of the fold 9. The undulating edge of the undulating depressions 11 has a high point 13 in said first section. The free edge 15 likewise runs in slightly lowered fashion in a corner region at the transition to the narrow side 8. In said second section, the undulating edge of the undulating depressions 11 has a high point 13, whereas a profile of the undulating edge of the undulating depressions 11 with a low point 14 is situated between said two sections. By way of said arrangement, the stress loading of the heat exchanger 1 can be reduced.

Considering the brazing boundary 12 which runs along the undulating edge of the undulating depressions 11, as per FIGS. 3 and 4, it can be seen that said brazing boundary has, in the region of the high point 13 and/or of the low point 14, two flanks 16, 16' which are angled relative to the horizontal in each case by an angle $\alpha$ of $7° \leq \alpha \leq 30°$. The brazing boundary 12 itself may, in all embodiments, have a height difference h of 1.5 mm≤h≤2.5 mm between the high point 13 and the low point 14, and a wavelength l of 4.0 mm≤l≤26 mm. Considering FIGS. 3 to 6 once again, it can be seen that the undulating brazing boundary 12 transitions via a high point 13 into the narrow side 8 of the rim hole 5. In this way, a reduction of the stress loading in the rounded transition region between long side 7, on the one hand, and narrow side 8, on the other hand, is also possible.

Figure 5:
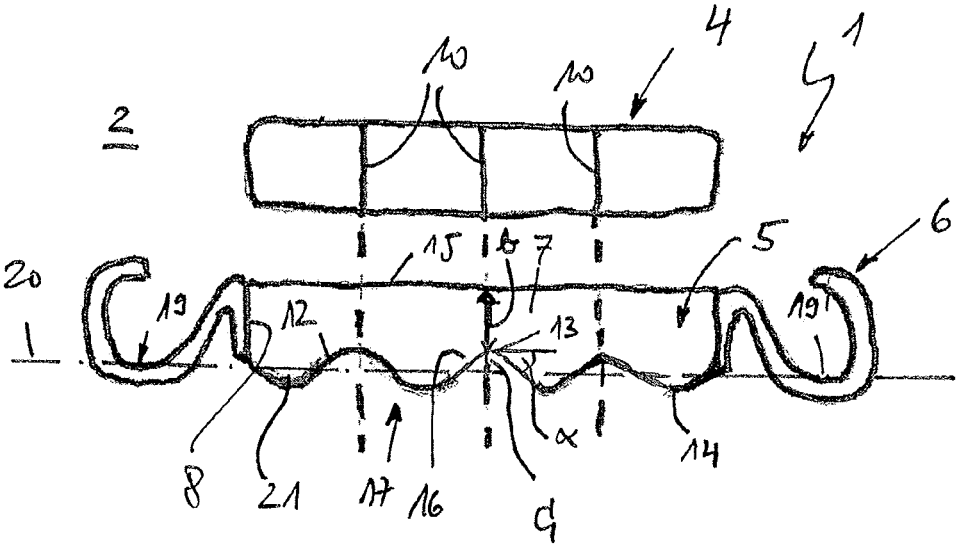
FIG. 5 is an illustration as in FIG. 3, but with a free edge of the rim hole directed toward the heat exchanger block.

Considering the heat exchanger 1 as per FIG. 5, it can be seen that said heat exchanger substantially corresponds to the heat exchanger 1 as per FIG. 2, but has an edge directed toward the heat exchanger block 3. The undulating brazing boundary 12 is in this case the edge of the undulating section of the brazing surface, in particular of the lugs 21, but without an adjoining surface region beyond the brazing boundary 12 or brazing surface, in particular without adjoining depressions.

Figure 6:
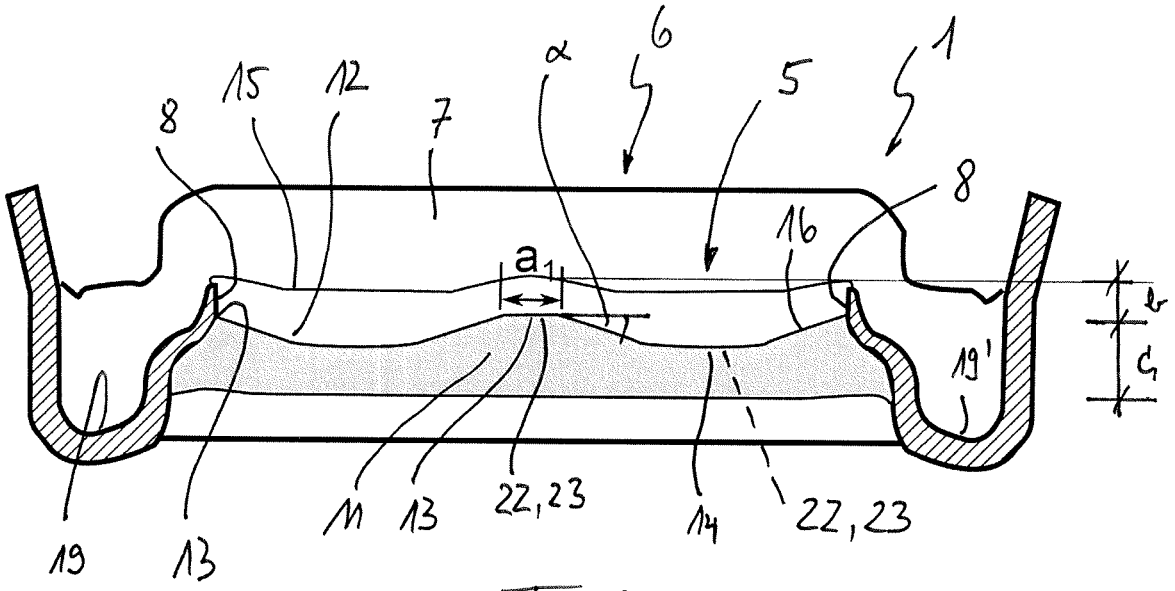
FIG. 6 is a sectional illustration through a tube plate of the heat exchanger according to the invention in the region of a rim hole, with a plateau at a high point of the brazing boundary.

FIG. 6 shows that a straight brazing boundary section 23 which forms a plateau 22 is provided in the region of at least one high point 13 of the brazing boundary 12. Said plateau 22 has a length al. Analogously, it would self-evidently also be possible for a straight brazing boundary section 23 which forms a plateau 22 to be provided in the region of at least one low point 14 of the brazing boundary 12, as illustrated in FIG. 6 by a dashed line. The length al in this case advantageously amounts to between 2 and 3 mm. Advantages arise with regard to a smaller space requirement in terms of height if the high points 13 can be flattened.

With the heat exchanger 1 according to the invention and in particular with the tube plate 6 designed according to the invention, it is possible to realize a considerably reduced stress loading in heat exchangers 1 with flat tubes 4.

The invention claimed is:

1. A heat exchanger, comprising:

a heat exchanger block including a plurality of rim holes disposed in a tube plate and a plurality of flat tubes held at a longitudinal end side in a respective one of the plurality of rim holes, the plurality of rim holes each having at least two mutually opposite and substantially straight long sides and at least two mutually opposite narrow sides, and the plurality of flat tubes are brazed to the at least two long sides and to the at least two narrow sides of the plurality of rim holes;

a brazed connection having an undulating brazing boundary provided between at least one long side of the at least two long sides of at least one rim hole of the plurality of rim holes and a corresponding one of the plurality of flat tubes arranged therein;

at least one of the plurality of flat tubes includes at least one partition;

wherein the undulating brazing boundary has, in a region of the at least one partition, a high point disposed between two low points with the high point defining an increased width in relation to a plane running through two opposite groove bases disposed in the tube plate;

wherein the at least one long side of the at least one rim hole includes undulating depressions disposed at an insertion side of the at least one rim hole to provide an undulating edge running between the undulating depressions and a free edge of the at least one rim hole, the free edge disposed on the at least one rim hole away from the plane in relation to the insertion side, and wherein the undulating edge defines the undulating brazing boundary of the brazed connection;

wherein the undulating edge extends along the at least one long side spaced apart from the free edge of the at least one rim hole to provide a brazing surface running along the at least one long side between the undulating brazing boundary and the free edge, and wherein the high point of the undulating brazing boundary defines a reduced width in relation to the free edge as compared to the two low points of the undulating brazing boundary;

wherein the undulating depressions adjoin the undulating brazing boundary on the at least one long side in a direction towards the plane and define a surface region between the undulating edge and the insertion side of the at least one rim hole, and wherein the undulating depressions are indented into the at least one rim hole in a direction transversely to a tube longitudinal axis; and wherein a width of the brazing surface between the free edge and the undulating edge is greater at the two low points than at the high point.

2. The heat exchanger according to claim 1, wherein the undulating brazing boundary has, in a region of the high point, at least two flanks angled relative to the plane by an angle ranging from 7° to 30°.

3. The heat exchanger according to claim 1, wherein at least one of:

at least one flat tube of the plurality of flat tubes is configured as a folded flat tube and has the at least one partition, and wherein the at least one partition is configured as a fold, at least one flat tube of the plurality of flat tubes is configured as a welded flat tube, and at least one flat tube of the plurality of flat tubes is an extruded flat tube.

4. The heat exchanger according to claim 1, wherein the undulating brazing boundary defines a height difference ranging from 1.5 mm to 2.5 mm between the high point and at least one of the two low points.

5. The heat exchanger according to claim 1, wherein the undulating brazing boundary has a wavelength defined between two adjacent high points ranging from 4.0 mm to 26.0 mm.

6. The heat exchanger according to claim 1, wherein the undulating brazing boundary has another high point that transitions into at least one of the at least two narrow sides of the at least one rim hole.

7. The heat exchanger according to claim 1, wherein the insertion side is disposed on the at least one rim hole opposite to the free edge and faces toward a long-side tube centre of the corresponding one of the plurality of flat tubes.

8. The heat exchanger according to claim 1, wherein each of the at least two long sides of the at least one rim hole have the undulating brazing boundary provided by said undulating depressions.

9. The heat exchanger according to claim 1, wherein the undulating brazing boundary has a number of high points corresponding to a number of partitions.

10. The heat exchanger according to claim 1, wherein said undulating depressions define an insertion bevel.

11. The heat exchanger according to claim 1, wherein the undulating brazing boundary has a straight brazing boundary section that defines a plateau, and wherein the straight brazing boundary section is disposed in a region of the high point of the undulating brazing boundary.

12. The heat exchanger according to claim 1, wherein the undulating depressions comprise indentations disposed on the at least one long side, structured and arranged to define the undulating edge of the undulating brazing boundary.

13. A motor vehicle, comprising: at least one heat exchanger, the at least one heat exchanger including:

a heat exchanger block including a plurality of rim holes disposed in a tube plate respectively receiving a corresponding one of a plurality of flat tubes at a longitudinal end side, the tube plate including two opposite groove bases, and the plurality of rim holes each having at least two mutually opposite and substantially straight long sides and at least two mutually opposite narrow sides, and wherein the plurality of flat tubes are brazed to the at least two long sides and to the at least two narrow sides of the plurality of rim holes;

a brazed connection having an undulating brazing boundary defined between at least one long side of the at least two long sides of at least one rim hole of the plurality of rim holes and a corresponding one of the flat tubes arranged therein, wherein the at least one long side of the at least one rim hole has an undulating edge defining the undulating brazing boundary;

wherein at least one of the plurality of flat tubes includes at least one partition;

wherein the undulating brazing boundary has a plurality of high points and a plurality of low points, and wherein at least one high point of the plurality of high points is disposed in a region of the at least one partition and defines an increased width in relation to a plane running through the two opposite groove bases of the tube plate;

wherein the at least one long side includes undulating depressions disposed at an insertion side of the at least one rim hole, structured and arranged to provide the undulating edge running between the undulating depressions and a free edge of the at least one rim hole disposed away from the plane in relation to the insertion side, and the undulating edge of the undulating brazing boundary extends along the at least one long side spaced apart from the free edge of the at least one rim hole to provide a brazing surface running between the undulating edge and the free edge;

wherein the undulating depressions comprise indentations provided on the at least one long side that are indented into the at least one rim hole in a direction transversely to a tube longitudinal axis, structured and arranged to define the undulating edge of the undulating brazing boundary; and wherein the plurality of high points of the undulating brazing boundary define a reduced width in relation to the free edge as compared to the plurality of low points, and wherein a width of the brazing surface between the free edge and the undulating edge is greater at the plurality of low points than at the plurality of high points.

14. The motor vehicle according to claim 13, wherein at least one of:

the plurality of high points are disposed towards the free edge of the at least one rim hole in relation to the plurality of low points; and the free edge of the at least one long side of the at least one rim hole has a curved profile.

15. The motor vehicle according to claim 13, wherein the undulating brazing boundary transitions via at least one other high point of the plurality of high points into at least one narrow side of the at least two narrow sides of the at least one rim hole.

16. The motor vehicle according to claim 13, wherein the undulating brazing boundary has a wavelength defined between two adjacent high points of the plurality of high points ranging from 4.0 mm to 26.0 mm.

17. The motor vehicle according to claim 13, wherein the undulating brazing boundary has a straight brazing boundary section that defines a plateau, and wherein the straight brazing boundary section is disposed in a region of the at least one high point of the undulating brazing boundary.

18. The heat exchanger according to claim 13, wherein the insertion side is disposed on the at least one rim hole opposite to the free edge and faces toward a long-side tube centre of the corresponding one of the plurality of flat tubes arranged therein.

19. The motor vehicle according to claim 13, wherein the undulating depressions adjoin the undulating brazing boundary on the at least one long side in a direction towards the plane and provide a surface region between the undulating edge and the insertion side of the at least one rim hole.

* * * * *